United States Patent [19]

Barbieri et al.

[11] 4,234,090

[45] Nov. 18, 1980

[54] MARKER SLEEVE ASSEMBLY

[75] Inventors: Joseph C. Barbieri, Cedarburg; Gary J. Wirth, Milwaukee, both of Wis.

[73] Assignee: W. H. Brady Co., Milwaukee, Wis.

[21] Appl. No.: 972,662

[22] Filed: Dec. 26, 1978

[51] Int. Cl.[3] ..... B65D 73/00

[52] U.S. Cl. ..... 206/459; 206/820; 40/316

[58] Field of Search ..... 40/316, 21 R, 19, 2; 206/820, 459, 480, 477, 488, 489

[56] References Cited

U.S. PATENT DOCUMENTS

| | | | |
|---|---|---|---|
| 3,924,738 | 12/1975 | Poupitch | 206/150 |
| 4,032,010 | 6/1977 | Evans | 40/316 |

FOREIGN PATENT DOCUMENTS

| | | | |
|---|---|---|---|
| 2655958 | 6/1978 | Fed. Rep. of Germany | 40/316 |
| 1216228 | 12/1970 | United Kingdom | 40/316 |

*Primary Examiner*—Louis G. Mancene
*Assistant Examiner*—Wenceslao J. Contreras
*Attorney, Agent, or Firm*—Quarles & Brady

[57] ABSTRACT

A marker sleeve assembly (1) comprising a plurality of marker sleeves (2, 3, 4, 5, 15 or 16) each joined to a longitudinal connecting member (6 or 6'). The connecting member is formed integrally with the marker sleeves and is attached to the outer wall of each sleeve in the assembly. The marker sleeves are detachably joined to the connecting member so that an individual marker sleeve can be removed from the connecting member for application to an article.

2 Claims, 7 Drawing Figures

MARKER SLEEVE ASSEMBLY

TECHNICAL FIELD

This invention relates to the field of marker sleeves which have generally tubular bodies adapted to encircle an article, usually for identification purposes.

BACKGROUND ART

Marker sleeves are often supplied to the user as a group of individual sleeves, packaged in a bag or pouch. This method of packaging, however, has a disadvantage of making it inconvenient for a user to select a particular sleeve which he wishes to apply about an article.

It has also been proposed to supply a group of marker sleeves secured to an adhesive coated strip. This is shown in U.S. Pat. No. 3,351,190. This system for assembling a group of marker sleeves has several disadvantages, including that it requires additional processing steps in order to properly align a group of marker sleeves and apply them to the adhesive-coated strip, and that it does not provide an efficient system that will allow registration of the group of sleeves for application of identifying indicia.

It has also been proposed, see U.S. Pat. No. 3,491,472, to provide a group of marker sleeves wherein adjacent sleeves are connected together along small interconnecting lands. The user can separate an individual sleeve from the group by breaking the interconnecting lands between it and its neighboring sleeve. This system also has several disadvantages. It does not provide an assembly of marker sleeves which includes provision for the efficient registration of the sleeves for the application of identifying indicia. Further, it does not allow the user to select a sleeve from the middle of the assembled group but, instead, he must sever the endmost sleeve from the assembly when he desires to apply a sleeve about an article.

DISCLOSURE OF THE INVENTION

The present invention relates to an assembly including a plurality of marker sleeves which are each detachably connected to a longitudinal connecting member. The longitudinal connecting member is formed integrally with the individual sleeve markers which it interconnects. This new construction has a number of significant technical advantages as compared to the prior art constructions noted above, which advantages will be discussed hereinbelow.

DISCLOSURE OF BEST MODES FOR CARRYING OUT THE INVENTION

Figure 1:
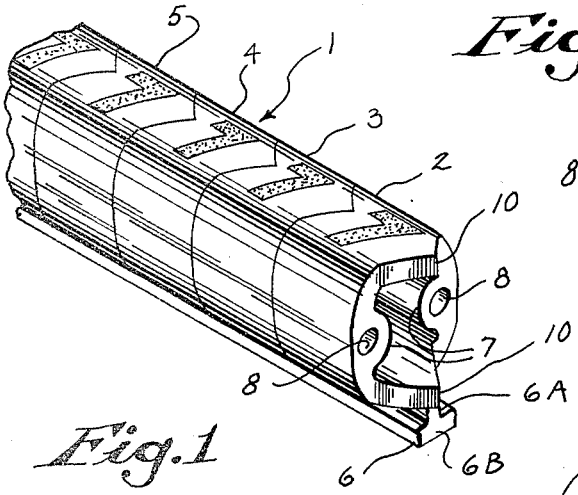
FIG. 1 illustrates a marker sleeve assembly according to the present invention in perspective view.

FIG. 1 illustrates a marker sleeve assembly 1 comprising a plurality of marker sleeves 2, 3, 4 and 5 which are each joined to a longitudinal connecting member 6. The connecting member 6 extends longitudinally of the group of marker sleeves, and it is joined to the outer wall of each sleeve. As indicated in the cross sectional view of FIG. 2, the marker sleeves 2–5 have an internal configuration including a pair of oppositely disposed inner webs 7, each connected at their ends to the interior surface of the outer wall of the marker sleeve and each separated from its adjacent overlying portion of the outer wall by an aperture 8. The internal structure of the sleeves 2–5 shown in the drawings is of a type covered by my co-pending application Ser. No. 972,934 filed, Dec. 26, 1978 entitled Marker Sleeves, filed on the same date as this application and owned by the same assignee. As noted below in connection with the discussion relating to FIG. 6, marker sleeves having other internal configurations may be employed in the marker sleeve assembly of this invention. The sleeves can be of any desired size, but they are often 0.1" to 1" or 2.5 mm to 25 mm long and about ⅛" to 1" or 3 mm to 25 mm in diameter.

Figure 3:
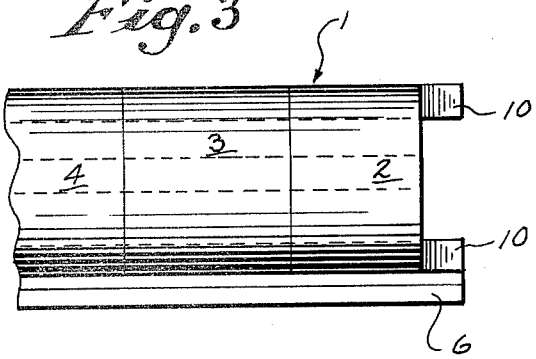
FIG. 3 is a side view of the assembly of FIG. 1.
Figure 4:
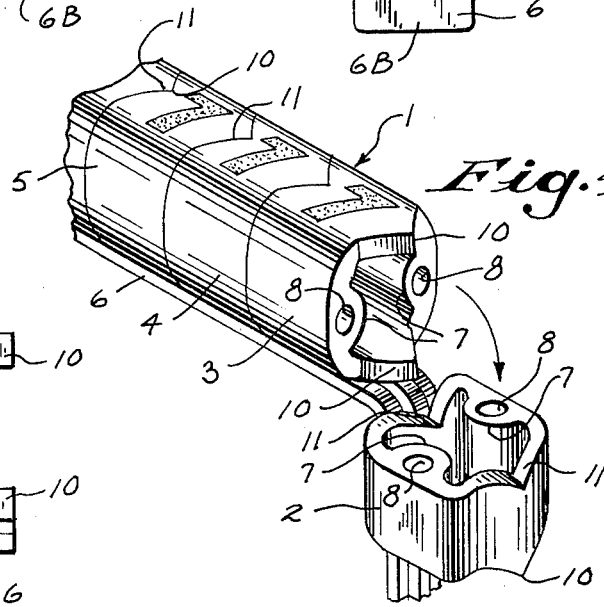
FIG. 4 illustrates the assembly of FIG. 1 in the condition while a marker sleeve is being removed therefrom.

As shown in FIGS. 1, 3 and 4, the marker sleeves 2–5 include tongues 10 projecting from one end wall thereof and grooves 11 formed in their opposite end wall which have a shape that mates with the projecting tongues. When two or more sleeves are applied to an object, the mating grooves and tongues enable one sleeve to be appropriately aligned with its neighbor. However, the end walls of the marker sleeves to be used in the assembly of the present invention may have other configurations, including for example flat end walls which are perpendicular to the longitudinal axis of the sleeve, curved end walls or other shaped configurations which would permit interengagement of a marker sleeve with its neighbor.

Figure 2:
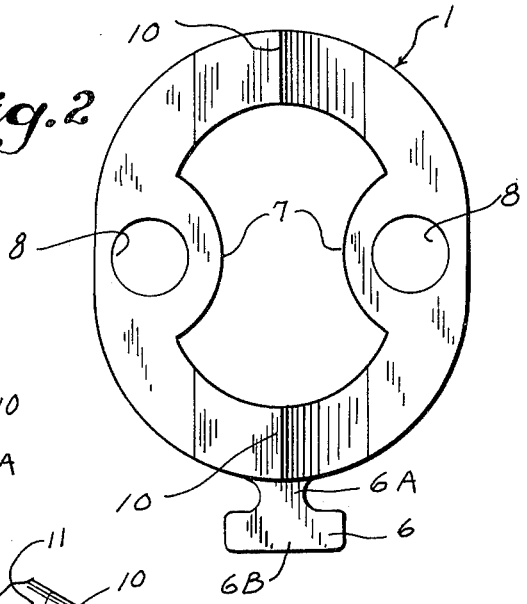
FIG. 2 is a cross sectional view of the assembly of FIG. 1.

As best shown in FIG. 2, the connecting member 6 includes a relatively narrow neck portion 6A which is joined to each of the marker sleeves and a relatively larger flange portion 6B which extends from the neck portion. The connecting member 6 thus has a generally T-shape.

The use of the marker sleeve assembly 1 is depicted in FIG. 4. When a user desires to apply one of the marker sleeves about an article, he merely grasps the selected marker sleeve and peels it away from the connecting member 6. This is illustrated in connection with the endmost marker sleeve 2 in FIG. 4. Thus the construction of the connecting member 6 should be such as to enable removal of a marker sleeve therefrom, i.e. the marker sleeves are detachably joined to the connecting member. A connecting member with a neck portion about 0.030" or 0.75 mm wide and a flange portion about 0.080"×0.025" or 0.20 mm×0.06 mm has been found useful, although other sizes may be employed. It should also be pointed out, however, that if the user desires to select a marker sleeve other than the endmost one, such as the marker sleeve 4 of FIG. 1 for example, he can remove it from the connecting member 6 in a similar manner but the other marker sleeves can remain joined to the connecting member.

Figure 5:
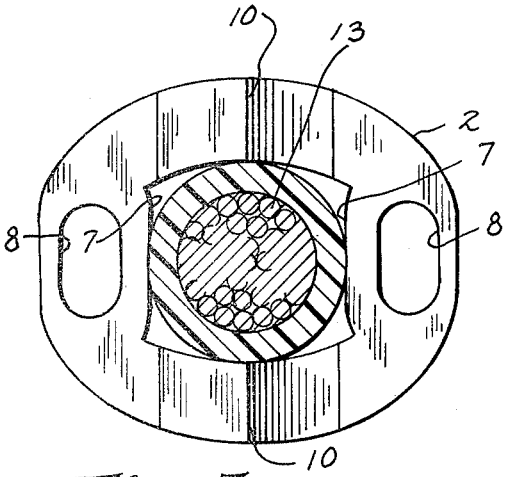
FIG. 5 shows a marker sleeve from the assembly of FIG. 1 applied to an object.

The application of a marker sleeve to an article is illustrated in FIG. 5 wherein the marker sleeve 2, after having been removed from the assembly, is inserted about an article 13 illustrated for exemplary purposes as an electrical wire having an outer layer of insulating material. The article 13 extends through the hollow tubular body of the marker sleeve. Marker sleeves of the type illustrated will generally include alpha-numeric information such as the numeral 7 shown in FIG. 1 for the purpose of identifying the article to which a marker sleeve is applied. The information may include letters, serial numerals, trademark information, etc. Also, the marker sleeves may have no applied indicia but instead be of selected colors to provide a color-coded identification. In some instances a marker sleeve of this type may be used solely for its insulation purposes when used in connection with an electrical wire or terminal, for example, in which event it need have no particular color code or identifying alpha-numeric information.

Figure 6:
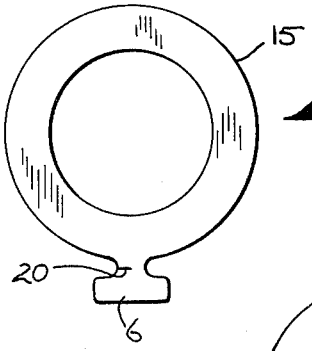
FIG. 6 illustrates the present invention employed with a marker sleeve of a different construction than that of FIGS. 1–5.

FIG. 6 illustrates the present invention employed with a marker sleeve having a different configuration than the sleeves 2–5 shown in FIG. 1. In this drawing, a generally circular marker sleeve 15 is shown being joined to a connecting member 6. The marker sleeve 15 has a smooth internal configuration and it has flat end walls rather than the tongue and groove construction of the previous marker sleeves. The marker sleeves to be employed with the assembly of the present invention may have circular or oval cross sectional shapes, or other cross sections if so desired. They may include an internal wall configuration which will provide for engagement with an article to which a sleeve is applied, or they may have externally formed grooves or folds such as found in some other prior art sleeves. In any event, the marker sleeves have an outer wall which forms a generally tubular body having a hollow interior through which an article is inserted when the sleeve is applied to the article.

Figure 7:
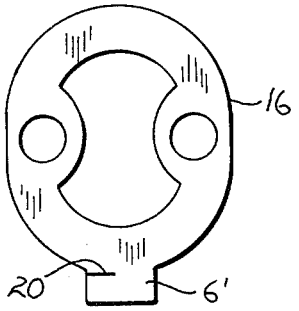
FIG. 7 illustrates the present invention with a different form of connecting member than shown in FIGS. 1–6.

The connecting member 6 as illustrated in FIGS. 1–6 has a generally T-shape. However, other configurations may be employed for the cross-sectional shape of a connecting member. Further, the connecting member need not include a narrow neck portion as shown in FIGS. 1–6, although this has been found to be a particularly useful structure. With reference to FIG. 7, a connecting member 6' is depicted as being joined to marker sleeve 16 which has an internal construction the same as marker sleeves 2–5, there being a plurality of marker sleeves 16 detachably joined to the connecting member 6'. The connecting member 6' in this embodiment has a rectangular shape and does not have a neck portion. Among the other configurations which can be used for a connecting member are square, round or triangular cross-sectional shapes.

The marker sleeves to be employed with the assembly of the present invention are best formed from thermoplastic material which is extruded to develop the selected shape of the marker sleeve and to form the connecting member as an element integral with the sleeves as shown in FIGS. 2 and 6. Suitable materials include thermoplastics, particularly those which have sufficient elasticity to allow the sleeve to expand slightly when it is applied to an article. Specific materials include polyvinylchloride homopolymers and copolymers, nylons, ABS materials, polyolefins such as polyethylene and polypropylene polymers and copolymers and fluorocarbons such as polytetrafluorethylene. Elastic materials such as natural and synthetic rubbers, appropriately compounded to provide the desired rigidity and slight elasticity may also be employed. When alpha-numeric data is to be applied to a marker sleeve, it may be applied by printing, hot stamping, embossing of the sleeves or any other desired manner. If color coding is used as a means of identification, the marker sleeves should be of a material which can be readily colored such as by blending coloring agents with the material or applying a colored coating.

By employing an extruded plastic material for the construction of the sleeve assembly 1 of this invention, a group of marker sleeves and a connecting member can be formed simultaneously and the connecting member formed integral with the marker sleeves. When a T-shaped connecting member such as the member 6 shown in the drawings is employed with the construction, the neck portion 6A thereof should be appropriately sized so that a user can readily separate a marker sleeve from the assembly. If so desired the neck portion of the connecting member may include a slit 20 (see FIGS. 6 and 7) which extends partly through the neck protion and is positioned closely adjacent each marker sleeve in the assembly. The slit 20 extends longitudinally of the assembly 1. The use of a slit in this fashion facilitates the removal of a selected marker sleeve from the assembly.

The marker sleeve assembly disclosed herein has a number of extremely useful technical advantages. Firstly, the user is furnished with a string or group of marker sleeves each joined to a connecting member instead of being furnished with a pile or bag full of individual markers. In this respect, then, the connecting member performs a packaging function so in that a user is provided with an ordered arrangement of marker sleeves which is very convenient to use. Secondly, the individual marker sleeves in an assembly of the present invention may contain sequential alpha-numeric information. Thus, the marker sleeves 2–5 as shown in FIG. 1 may each have a series of numbers such as 1-2-3-4 or letters such as A-B-C-D, etc. It is inconvenient to provide this feature when sleeves are supplied as separate articles. Thirdly, a user has the ability to remove an interior marker sleeve from the assembly while the endmost marker sleeves remain attached to the connecting member, and he is not limited to selecting only the endmost marker sleeve. Thus, one can select an individual marker sleeve and yet preserve the integrity of the overall assembly. Fourthly, one of the problems of manufacturing marker sleeves is that of obtaining proper alignment of the sleeves when alpha-numeric information is printed or otherwise applied to individual sleeves. The connecting member of the assembly of the present invention provides a guiding element which can be used in connection with an appropriate device so that a strip of the material can be accurately advanced through a printing press or other apparatus and proper registration of the indicia with respect to an individual sleeve marker can be obtained. Also, the connecting member may serve as a guide as an extruded tube is moved through suitable die cutting apparatus to form individual markers out of the tube. In these and other respects, the marker sleeve assembly of the present invention provides a new and useful construction which facilitates the manufacturing of marker sleeves and which provides the user with a convenient package from which individual markers can be readily selected and dispensed.

We claim:

1. A marker sleeve assembly comprising:

(a) a plurality of individual marker sleeves each having an outer wall which defines a hollow generally tubular body which is to be positioned about an article; and (b) a connecting member joined to the outer wall of each of the marker sleeves and extending longitudinally thereof, the connecting member being formed integrally with the marker sleeves, (c) a longitudinally extending slit formed in the connecting member closely adjacent each marker sleeve, the slit extending partly through the connecting member, and (d) each marker sleeve in the assembly being individually removable from the connecting member along the slit for application to an object while other marker sleeves in the assembly remain joined thereto.

2. A marker sleeve assembly according to claim 1 wherein:

the connecting member is generally T-shape and includes a narrow neck portion joined to each of the marker sleeves and a broader flange portion extending from the neck portion, said longitudinally extending slit being formed in the neck portion of the connecting member.

* * * * *